US005895882A

United States Patent [19]

Woodall, Jr.

[11] Patent Number: 5,895,882

[45] Date of Patent: Apr. 20, 1999

[54] AIR-DELIVERED REMOTELY-ACTIVATED INFRARED ANTI-SHIP MISSILE DECOY AND DEPLOYMENT METHOD

[75] Inventor: Robert C. Woodall, Jr., Lynn Haven, Fla.

[73] Assignee: The United States of America as represented by the Secretary of the Navy, Washington, D.C.

[21] Appl. No.: 08/986,982

[22] Filed: Dec. 8, 1997

[51] Int. Cl.[6] ..... F42B 4/26; F42B 12/46

[52] U.S. Cl. ..... 102/341; 102/336; 102/342; 102/348; 102/352; 102/356; 102/360; 102/367

[58] Field of Search ..... 102/336, 341, 102/342, 348, 352, 356, 360, 367

[56] References Cited

U.S. PATENT DOCUMENTS

| | | | |
|---|---|---|---|
| 3,992,628 | 11/1976 | Karney | 102/367 X |
| 4,498,392 | 2/1985 | Billard et al. | 102/342 |
| 5,331,897 | 7/1994 | Handler | 102/341 |
| 5,343,794 | 9/1994 | Andreotti et al. | 102/341 X |
| 5,390,605 | 2/1995 | Meili et al. | 102/342 X |
| 5,602,362 | 2/1997 | Billard et al. | 102/342 X |

*Primary Examiner*—Peter A. Nelson

*Attorney, Agent, or Firm*—Harvey A. Gilbert; Kenneth W. Dobyns

[57] ABSTRACT

An air-delivered infrared anti-ship missile decoy is delivered from an aircraft to a desired location below sea surface ahead of advancing forces and then activated at a later time by a remotely-transmitted encoded signal to separate a payload assembly from the remainder of the decoy, float the payload assembly on the sea surface and then produce a relatively large infrared plume above the payload assembly and atop the sea surface that provides an infrared signature for decoying and deception purposes.

20 Claims, 3 Drawing Sheets

AIR-DELIVERED REMOTELY-ACTIVATED INFRARED ANTI-SHIP MISSILE DECOY AND DEPLOYMENT METHOD

CROSS-REFERENCE TO RELATED APPLICATION

The subject matter of this application is related to that of U.S. Pat. No. 5,661,258 entitled "Air-Delivered Ordnance Explosive Mine And Obstacle Clearance Method" by Felipe A. Garcia et al. (Navy Case No. 76918).

BACKGROUND OF THE INVENTION

1. Field of the Invention

The present invention generally relates to missile decoys and, more particularly, is concerned with an air-delivered, delayed remotely-activated, infrared anti-ship missile decoy and deployment method.

2. Description of the Prior Art

Currently, when a missile launch is detected decoys are launched off the deck of Naval combatants by a decoy launching system. These decoys fool air-to-surface missile guidance control into targeting the decoy instead of the ship. The fleet can launch both infrared (IR) and radio frequency (RF) decoys to counter IR or RF homing missiles. These decoys are launched via mortar or rocket propulsion from the deck of the surface ship. An example of a torpedo decoy round ejected for flight above water from a mortar or missile launcher located onboard a naval surface vessel is disclosed in U.S. Pat. No. 5,341,781 to Woodall, Jr. et al.

Surface ship launched decoys have a limited separation range from the ship's launcher. Range is limited by the amount of propulsion that can be provided via mortar or rocket, by the storage confines for shipboard ordnance, and by launcher material strength limits. Storage requirements also limit the time that the decoy can provide deception before ceasing to function by limiting the amount of fuel held in the device.

A drawback of current decoy systems is that they function immediately upon launch. They cannot be placed at a predetermined location and then activated so as to function at some later time by remote means.

Consequently, a need exists for an improved decoy design which will overcome the drawbacks of the prior art without introducing new ones in their place.

SUMMARY OF THE INVENTION

The present invention provides an air-delivered infrared anti-ship missile decoy and deployment method designed to satisfy the aforementioned need. The missile decoy of the present invention is delivered by release from an aircraft and adapted to be placed in a dormant state ahead of advancing forces (specifically amphibious elements) and then activated by an encoded (or encrypted) signal transmitted from a remote location to produce an infrared (IR) signature plume for various decoying and deception purposes.

Accordingly, the present invention is directed to an air-delivered infrared anti-ship missile decoy which comprises: (a) an elongated body having an interior chamber and a detonation mechanism disposed forwardly of the interior chamber and in communication therewith and being activatable from an unarmed condition to an armed condition in response to launch of the decoy into flight to a desired location below sea surface; (b) a payload assembly disposed in the interior chamber of the elongated body and having an inflatable flotation body, an actuatable mechanism coupled to the flotation body for inflating the flotation body to cause flotation of the payload assembly on the sea surface, and a generating mechanism activatable for producing an infrared plume above the payload assembly and atop the sea surface; and (c) an aft tail assembly detachably attached to the elongated body and having a receiver responsive to an encoded signal received from a remote location to produce a firing signal that detonates the detonation mechanism causing detachment of the aft tail assembly from the elongated body and ejection of the payload assembly from the interior chamber thereof, initiating flotation of the payload assembly via inflation of the flotation body on the sea surface, and activating the generating mechanism in the payload assembly to produce the infrared plume above the payload assembly and atop the sea surface.

The elongated body includes a middle shell and a forward nose assembly. The middle shell has forward and rearward ends with the interior chamber extending therebetween. The forward nose assembly has a rear end attached to the forward end of the middle shell. The aft tail assembly has a front end detachably attached to the rearward end of the middle shell.

More particularly, the detonation mechanism includes a rear detonatable separation charge and a front arming device disposed forwardly of the rear detonatable separation charge. The front arming device is activatable from the unarmed condition to the armed condition in firing alignment with the rear detonatable separation charge in response to launching of the decoy into flight to the desired location below the sea surface. The aft tail assembly includes means for stabilization of flight of the decoy in the form of fins that are deployable externally thereof upon launching of the decoy into flight.

The present invention is also directed to an air-delivered infrared anti-ship missile decoy deployment method which comprises the steps of: (a) providing the above-defined air-deliverable infrared anti-ship missile decoy; (b) launching the decoy into flight through the air to a desired location below sea surface; (c) arming the decoy in response to air flow pressure against the decoy during the flight thereof; (d) after delivery of the decoy to below the sea surface at the desired location, generating an encoded signal from a remote transmitter and receiving the signal at the decoy; (e) in response to receiving the signal at the decoy, causing separation and flotation of a payload assembly of the decoy from a remainder of the decoy; and (f) in response to the separation and flotation of the payload assembly, producing from the payload assembly an infrared plume atop the sea surface. The infrared plume is produced by activating a generating mechanism in the payload assembly to project a flame and a stream of atomized fuel from the payload assembly into the flame above the sea surface.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
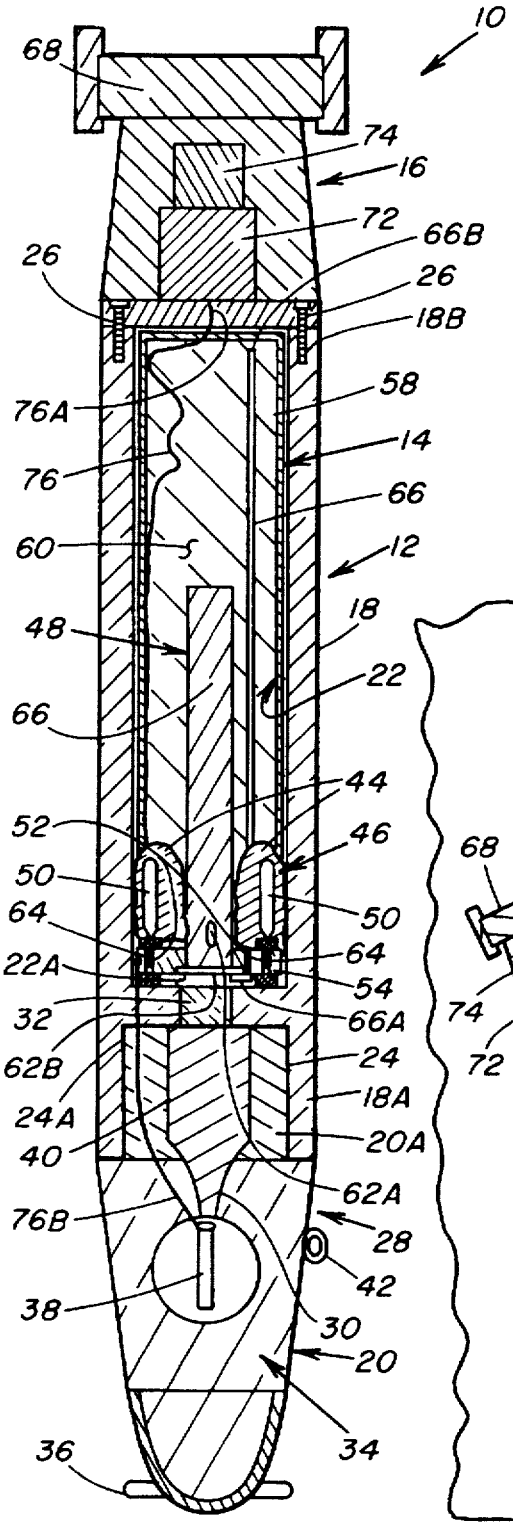
FIG. 1 is a longitudinal sectional view of an air-delivered infrared anti-ship missile decoy of the present invention.
Figure 2:
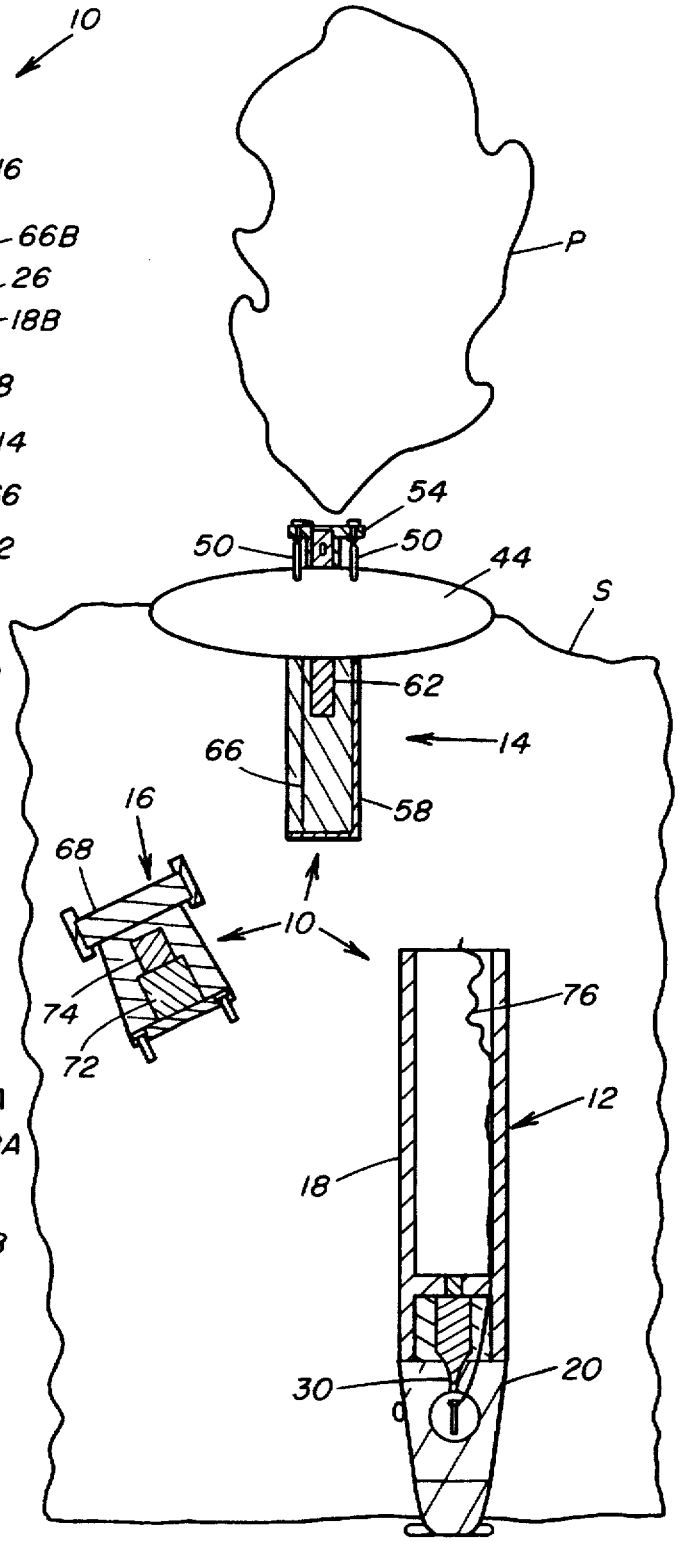
FIG. 2 is a side elevational view illustrating the missile decoy at a desired sea location where a payload assembly has separated from the remainder of the decoy and is floating at the sea surface producing an infrared plume atop the sea surface.

Referring to the drawings and particularly to FIGS. 1 and 2, there is illustrated an air-delivered infrared anti-ship missile decoy, generally designated 10, of the present invention. Basically, the missile decoy 10 includes an elongated body 12, a payload assembly 14 and an aft tail assembly 16.

The elongated body 12 of the decoy 10 includes a middle shell 18 and a forward nose assembly 20. The middle shell 18 has opposite forward and rearward ends 18A, 18B and an elongated interior chamber 22 extending between the forward and rearward ends 18A, 18B. The forward nose assembly 20 has a rear end 20A inserted within a forward cavity 24 of the middle shell 18 where the forward nose assembly 20 is attached to the forward end 18A of the middle shell 18. The forward cavity 24 at its rear end 24A communicates with a forward end 22A of the elongated interior chamber 22. The aft tail assembly 16 has a front end 16A that is detachably attached by suitable shear means such as screws 26 to the rearward end 18B of the middle shell 18.

The elongated body 12 of the decoy 10 has a detonation mechanism 28 disposed in the forward nose assembly 20 forwardly of the interior chamber 22 of the middle shell 18 and extending into communication with the interior chamber 22 via the forward cavity 24 of the middle shell 18 and via a passage 30 in the middle shell 18 interconnecting the rear end 24A of the forward cavity 24 with the forward end 22A of the interior chamber 22. More particularly, the detonation mechanism 28 includes a rear detonatable separation charge 32 and a front arming device 34 disposed forwardly of the rear detonatable separation charge 32. The rear detonatable separation charge 32 is supported in the passage 30 of the middle shell 18. The front arming device 34 preferably, although not necessarily, is implemented by a well-known prior art MK32 arming device whose makeup and mode of operation is described in the patent application cross-referenced above, whose disclosure is incorporated herein by reference thereto. The front arming device 34 includes, among other components described in the cross-reference application, an arming vane 36, a fuze detonator 38 and booster charge 40 arranged in a fore-to-aft sequential relationship. The fuze detonator 38 and booster charge 40 are activatable from an unarmed condition to an armed condition upon rotation of the arming vane 36 in response to launch and flight of the decoy 10, for example from an aircraft, to a desired location below the sea surface S. For the activation from the unarmed condition to the armed condition, an arming wire release 42 on the exterior of the forward nose assembly 20 is removed upon launch of the decoy 10 into flight permitting the arming vane 36 to rotate in the airstream. The arming vane 36 rotates in response to air flow pressure imparted against the decoy 10 past the vane 36. As described in the cross-referenced patent application, vane rotation results in the fuze detonator 38 being brought into firing alignment with the booster charge 40 which, in turn, is coupled in a firing alignment with the rear detonatable separation charge 32.

The payload assembly 14 of the decoy 10 is disposed in the interior chamber 22 of the middle shell 18 of the elongated body 12. The payload assembly 14 includes an inflatable flotation body 44, an actuatable mechanism 46 coupled to the inflatable flotation body 44 for causing its inflation to cause, in turn, flotation of the payload assembly 14 at the sea surface S, and a generating mechanism 48 activatable for producing an infrared plume P above the floating payload assembly 14 and atop the sea surface S. The inflatable flotation body 44 may take any suitable form such as an annular shaped flexible inflatable collar. The actuatable mechanism 46 for causing inflation of the flotation body 44 may take any suitable form, such as one or more bottles 50 of pressurized carbon dioxide gas and piercing pins 52 aligned with the bottles 50 and retrained by springs from moving toward and puncturing the bottles to release the pressurized gas and inflate the flotation body 44. The flotation body 44 upon inflating will buoy the payload assembly 14 to the sea surface S. The infrared plume generating mechanism 48 includes a platform 54 slidably received in the interior chamber 22 of the middle shell 18 and disposed adjacent to the forward end 18A thereof being spaced a short distance from the passage 30 by spacers 56, a fuel tank 58 of cylindrical shape slidably received in the interior chamber 22 of the middle shell 18 and sealably mounted at one end to the platform 54 for containing a predetermined quantity of fuel 60 in the fuel tank 58 and a gas generator 62 disposed in the fuel tank 58 and mounted at one end to the platform 54. The inflatable flotation body 44 is attached to the exterior of the fuel tank 58 and disposed around and outside thereof while the pressurized gas bottles 50 are disposed in the fuel tank 58 and supported from the platform 54. Also, the piercing pins 52 are reciprocally mounted in passageways 64 defined in the platform 54 and opening to the space between the platform 54 and forward end 18A of the shell 18. The gas generator 62 contains a suitable propellant which upon igniting generates a suitable pressurized gas and has a side port 62A which vents into the fuel tank 58. The gas generator 62 also has a front discharge orifice 62B.

Figure 4:
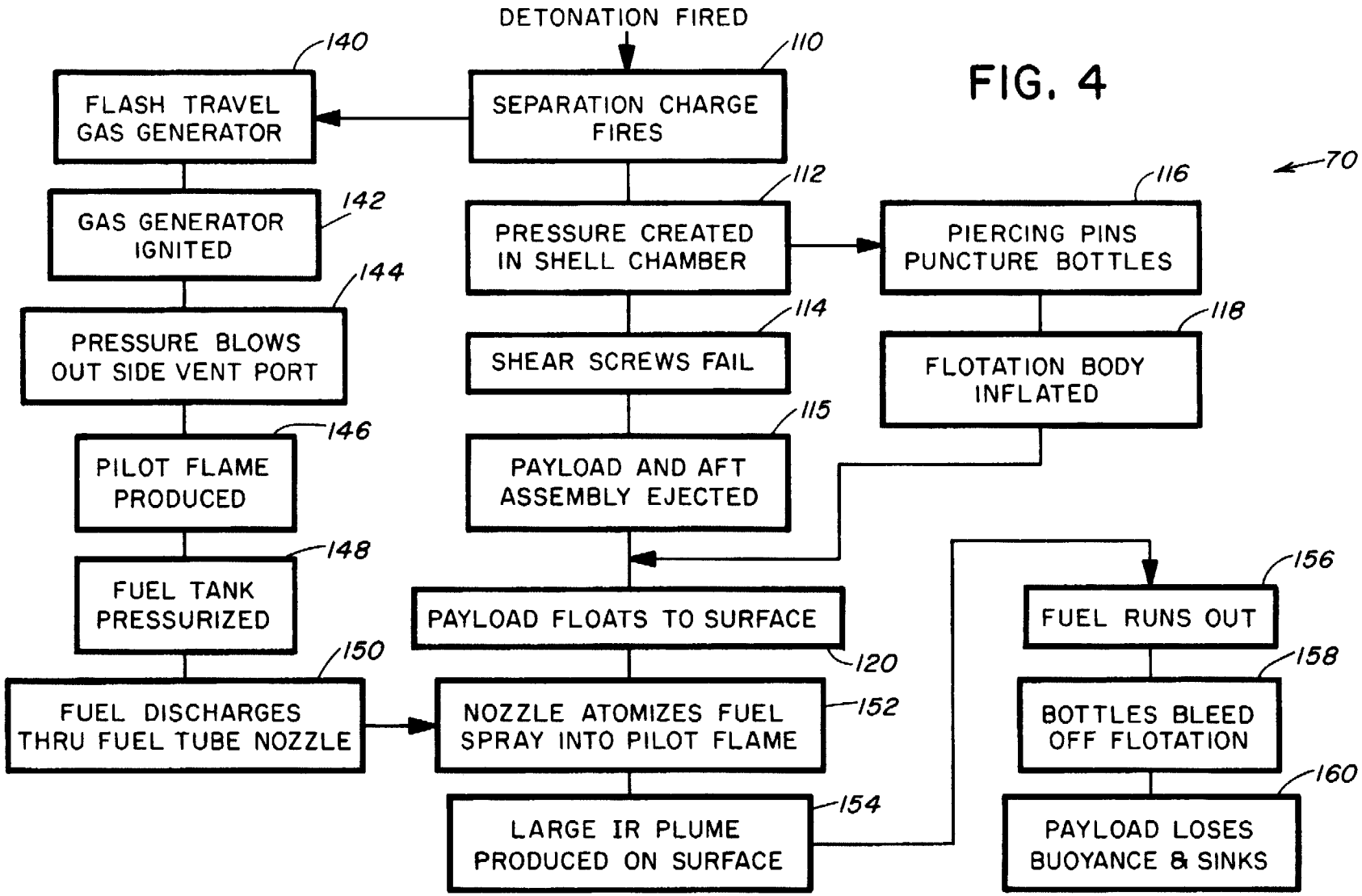
FIG. 4 is a detailed flow diagram of a portion of the deployment method of the present invention.

As represented by the steps described in the detailed flow chart, generally designated 70, in FIG. 4, detonation or firing 110 of the rear separation charge 32 of the detonation mechanism 28 creates pressure 112 in the interior chamber 22 outside of the fuel tank 58 which causes the screws 26 to shear 114 separating the aft tail assembly 16 and ejecting 115 the payload assembly 14 from the interior chamber 22. The detonation of the separation charge 32 also creates pressure in the passageways 64 of the platform 54 which causes the piercing pins 52 to move rearwardly and pierce 116 the bottles 50, inflating 118 the flotation body or collar 44 which by now has been ejected from the interior chamber 22 with the platform 54 and fuel tank 58 of the payload assembly 14. The flotation collar 44 floats 120 the payload assembly 14 to the surface S. Furthermore, the flash 140 from the deflagrating separation charge 32 provides sufficient impetus to ignite 142 the propellant contained in the gas generator 62 and to blow out 144 the side vent port 62A of the gas generator 62 causing the propellant in the gas generator to burn in a known way and create flame 146 and pressure 148. A pilot flame flares out the front discharge orifice 62B of the gas generator 62 as pressurized gas is vented through the side port 62A into the fuel tank 58 forcing fuel 60 under pressure in the tank 54 to travel forwardly through a fuel tube 66 in the tank 54. The fuel tube 56 is supported at an outlet nozzle end 66A through the platform 54 and extends to a bottom or aft end 58A of the fuel tank 58 terminating a short distance therefrom and defining an inlet end 66B of the fuel tube 66. Fuel 60 under pressure escapes 150 from the outlet nozzle end 66A of the fuel tube 66 and is atomized into the pilot flame and ignited so as to produce the infrared plume P at 154 of a very large size above the platform 54 of the floating payload assembly 14 and atop the sea surface S. After the fuel 60 runs out 156, the bottles 50 bleed off the flotation 158 and the payload 14 loses buoyancy and sinks 60.

The aft tail assembly 16 detachably attached to the rearward end 18B of the middle shell 18 of the elongated body 12 includes means for stabilization of flight of the decoy 10 in the form of conventional fins 68 that in a conventional manner well-known to those of ordinary skill in the art are deployable externally of the aft tail assembly 16 upon launching of the decoy 10 into flight. The aft tail assembly 16 also includes a suitable receiver 72 and battery 74 electrically connected to the receiver 72 for powering the receiver 72. A firing signal wire 76 is also provided extending through the elongated body 12 and connected at one end 76A to the receiver 72 and at an opposite end 76B to the fuze detonator 38. The receiver 72, battery 74 and firing signal wire 76 preferably, although not necessarily, are the same as described in the patent application cross-referenced above, whose disclosure is incorporated herein by reference thereto. The receiver 72 is responsive to an encoded signal, such as an encrypted magnetic signal, generated from a remote transmitter, such as a standoff transmitter located at a standoff control station, as mentioned in the above cross-referenced patent application, the disclosure of which is incorporated by reference. The encoded signal is received by the receiver 72 to produce a firing signal conducted via the firing signal wire 76 to the fuze detonator 38 to cause detonation of the rear separation charge 32 of the detonation mechanism 28, via the fuze detonator 38 of the front arming device 34 of the detonation mechanism 28. As explained above, the interior chamber 22 is pressurized causing shearing of the screws 26 and detachment of the aft tail assembly 16 from the middle shell 18 of the elongated body 12, ejection of the payload assembly 14 from the interior chamber 22 of the middle shell 18, inflation and flotation 120 (FIG. 4) of the payload assembly 14 on the sea surface S and ignition of the gas generator 62 to produce the infrared plume P above the floating payload assembly 14 and atop the sea surface S.

Figure 3:
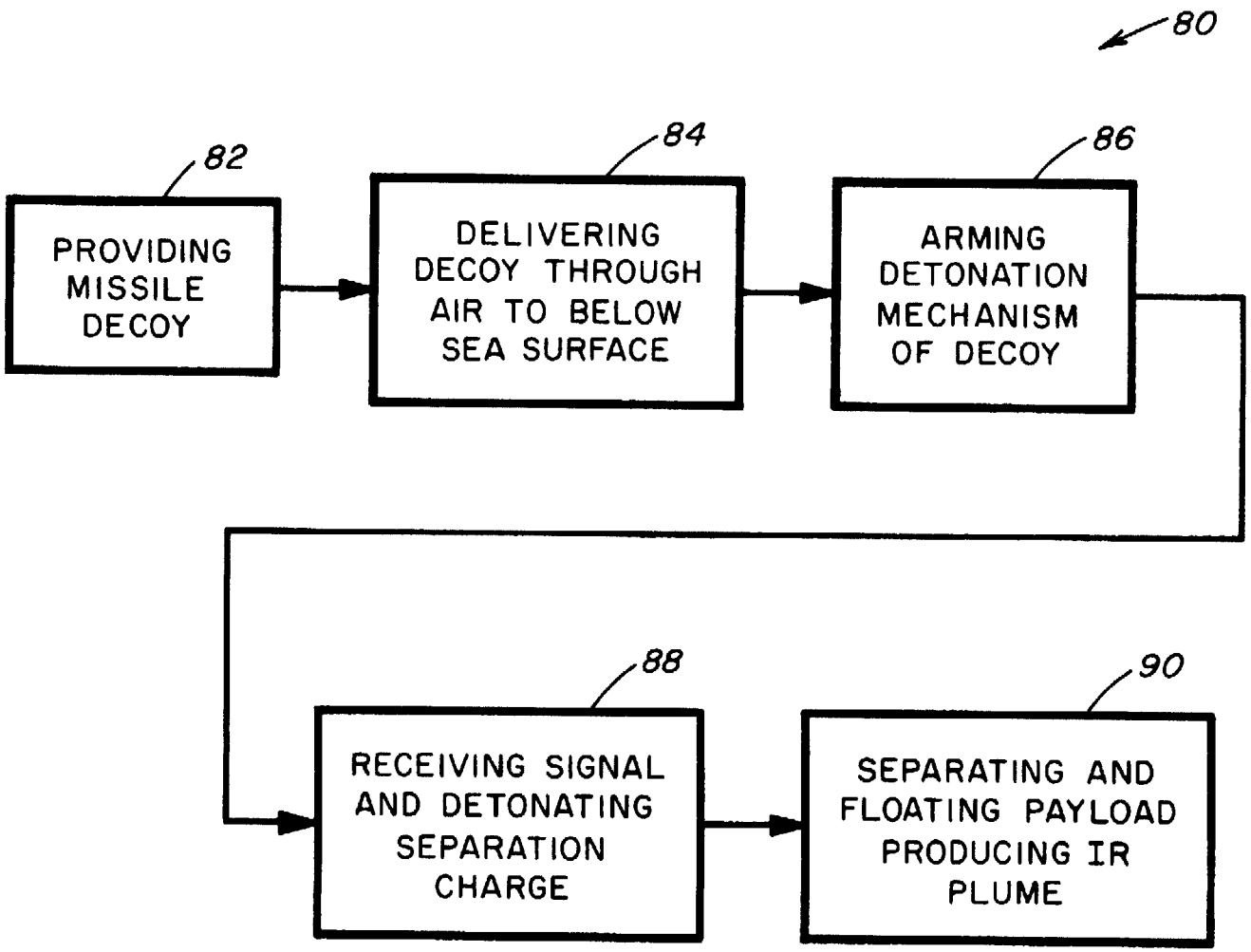
FIG. 3 is a general flow diagram of an air-delivered infrared anti-ship missile decoy deployment method of the present invention.

Referring now to FIG. 3, there is illustrated in a general flow diagram, generally designated 80, the basic steps of the deployment method of the present invention for the air-delivered infrared anti-ship missile decoy 10. As per block 82 of the flow diagram 80, the missile decoy 10 provided for delivery to the desired sea location preferably is the one described above with reference to FIGS. 1 and 2. This decoy 10 is designed with an external profile and activation features, as mentioned above, that are similar to air delivered general purpose bombs for enhanced deployment safety and accuracy. As per block 84 of the flow diagram 80, the missile decoy 10 is delivered to a desired sea location below the sea surface S by being launched in any suitable manner into flight through the air toward the desired sea location. Preferably, the mode of launching is through release from a high speed aircraft toward the desired sea location. As per block 86, the missile decoy is armed in response to launching and flight. More particularly, the removal of the arming wire release 42 and the pressure of air flow against the vane 36 of the front arming device 34 in the forward nose assembly 20 of the decoy 10 causes the arming of the activation mechanism 28 to occur. As per block 88, at a desired time after delivery of the missile decoy 10 to below the sea surface S at the desired location, the remotely-located transmitter generates the encoded signal, such as the encrypted magnetic signal, which is received by the receiver 72 in the aft tail assembly 16. The receiver 72 responds to the encoded signal by producing a firing signal which activates the detonation mechanism 28 to initiate separation and flotation of the payload assembly 14 from the remainder of the decoy 10. As per block 90, the payload assembly 14 responds to its separation from the remainder of the decoy 10 by rising to and floating at the sea surface S projecting a flame and stream of atomized fuel into the flame above the sea surface S to produce the infrared plume P atop the sea surface S.

With respect to the detailed flow diagram of FIG. 4, the steps of the deployment method of the present invention from delivering the decoy 10 to detonating the fuze detonator 38 and booster charge 40 are the same as described and shown with respect to the invention of the cross-referenced patent, thus the disclosure of such steps in the cross-referenced patent is hereby incorporated by reference. The remainder of the steps of the deployment method of the present invention which are illustrated in the detailed flow diagram 70 of FIG. 4 have been described above with reference to the description of the components of the payload assembly 14 and their mode of operation.

In conclusion, using the present invention to provide a remotely activated infrared decoy capability will allow for the protection of assault landing craft during amphibious encroachment and hostile beach landing operations. Fields of infrared-producing torches or plumes could be seeded by high speed aircraft prior to an amphibious assault near the landing zone. Upon initiation of a littoral landing offensive, fields of such plumes could be remotely activated to decoy, deceive and blind enemy fire targeted at amphibious assault assets. Use of the present invention by regular surface combatants may also prove useful. Making efficient use of the general purpose bomb profile, along with lengthening of the gas generator, allows the plumes to function longer and more efficiently than current infrared decoys.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. An air-delivered infrared anti-ship missile decoy, comprising:

(a) an elongated body having an interior chamber and a detonation mechanism disposed forwardly of said interior chamber and in communication therewith and being activatable from an unarmed condition to an armed condition in response to launch of the decoy into flight to a desired location below sea surface;

(b) a payload assembly disposed in said interior chamber of said elongated body and having an inflatable flotation body, an actuatable mechanism coupled to said flotation body for inflating said flotation body to cause flotation of said payload assembly on the sea surface, and a generating mechanism activatable for producing an infrared plume above said payload assembly and atop the sea surface; and (c) an aft tail assembly detachably attached to said elongated body and having a receiver responsive to an encoded signal received from a remote location to produce a firing signal that detonates said detonation mechanism causing detachment of said aft tail assembly from said elongated body and ejection of said payload assembly from said interior chamber thereof, initiating flotation of said payload assembly via inflation of said flotation body on the sea surface, and activating said generating mechanism in said payload assembly to produce said infrared plume above said payload assembly and atop the sea surface.

2. The decoy of claim 1 wherein said elongated body includes:

a middle shell having forward and rearward ends and said interior chamber extending between said forward and rearward ends;

a forward nose assembly having a rear end attached to said forward end of said middle shell.

3. The decoy of claim 2 wherein said aft tail assembly has a front end detachably attached to said rearward end of said shell.

4. The decoy of claim 1 wherein said aft tail assembly further has means for stabilization of flight of said decoy.

5. The decoy of claim 4 wherein said means for stabilization of flight of the decoy is fins provided on said aft tail assembly and deployable externally thereof upon launching of said decoy into flight.

6. The decoy of claim 1 wherein said detonation mechanism includes a rear detonatable separation charge disposed in communication with a forward end of said interior chamber and a front arming device disposed forwardly of said rear detonatable separation charge and connected thereto, said front arming device being activatable from said unarmed condition to said armed condition in firing alignment with said rear detonatable separation charge in response to launching of said decoy into flight to the desired location below the sea surface.

7. The decoy of claim 1 wherein said generating mechanism in said payload assembly when activated projects a flame and a stream of atomized fuel into said flame above the sea surface to produce said infrared plume atop the sea surface.

8. The decoy of claim 1 wherein said encoded signal is an encrypted signal.

9. The decoy of claim 1 wherein said encoded signal is a magneto-inductive signal.

10. An air-delivered infrared anti-ship missile decoy deployment method, comprising the steps of:

(a) providing an air-deliverable infrared anti-ship missile decoy;

(b) launching the decoy into flight through the air to a desired location below sea surface;

(c) arming the decoy in response to launching the decoy into flight;

(d) after delivery of the decoy to below the sea surface at the desired location, receiving an encoded signal at the decoy transmitted from a remote location;

(e) in response to receiving the signal at the decoy, causing separation and flotation of a payload assembly of the decoy from a remainder of the decoy; and (f) in response to separation and flotation of the payload assembly, producing from the payload assembly an infrared plume atop the sea surface.

11. The method of claim 10 wherein said decoy is provided with an elongated body including a middle shell and a forward nose assembly, said middle shell having forward and rearward ends and an interior chamber extending between said forward and rearward ends, said forward nose assembly having a rear end attached to said forward end of said middle shell.

12. The method of claim 11 wherein said decoy is further provided with an aft tail assembly having a front end detachably attached to said rearward end of said shell.

13. The method of claim 10 further comprising:

stabilizing said decoy during flight by providing an aft tail assembly having fins deployable externally during flight of said decoy.

14. The method of claim 10 wherein said arming of the decoy is in response to air flow pressure imparted against said decoy during the flight thereof.

15. The method of claim 10 wherein said decoy is further provided with an elongated body having an interior chamber, a rear detonatable separation charge disposed forwardly of said interior chamber and in communication with a forward end thereof, and a front arming device disposed forwardly of said rear detonatable separation charge and activatable from an unarmed condition to an armed condition in firing alignment with said rear detonatable separation charge in response to launching of said decoy into flight to the desired location below the sea surface.

16. The method of claim 15 wherein said decoy is further provided with a payload assembly disposed in said interior cavity of said elongated body, said payload assembly including an inflatable flotation body, an actuatable mechanism coupled to said flotation body for inflating said flotation body to cause flotation of said payload assembly on the sea surface, and a generating mechanism activatable for producing said infrared plume above said payload assembly and atop the sea surface.

17. The method of claim 16 wherein said decoy is further provided with an aft tail assembly attached to said elongated body and having a receiver in said aft tail assembly responsive to said encoded signal received from the remote location to produce a firing signal that detonates said separation charge in firing alignment with said arming device causing detachment of said aft tail assembly from said elongated body and ejection of said payload assembly from said interior chamber thereof, initiating flotation of said payload assembly via inflation of said flotation body on the sea surface, and activating said generating mechanism in said payload assembly to produce said infrared plume above said payload assembly and atop the sea surface.

18. The method of claim 17 wherein said infrared plume is produced by activating a generating mechanism in said payload assembly to project a flame and a stream of atomized fuel from said payload assembly into said flame above the sea surface.

19. The decoy of claim 10 wherein said encoded signal is an encrypted signal.

20. The decoy of claim 10 wherein said encoded signal is a magneto-inductive signal.

* * * * *